US011500329B2

(12) United States Patent
Suzuki et al.

(10) Patent No.: US 11,500,329 B2
(45) Date of Patent: Nov. 15, 2022

(54) CARTRIDGE AND MANUFACTURING METHOD OF CARTRIDGE

(71) Applicant: CANON KABUSHIKI KAISHA, Tokyo (JP)

(72) Inventors: Akira Suzuki, Kanagawa (JP); Kaori Noguchi, Shizuoka (JP); Yasunori Toriyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/341,211

(22) Filed: Jun. 7, 2021

(65) Prior Publication Data

US 2021/0389722 A1 Dec. 16, 2021

(30) Foreign Application Priority Data

Jun. 10, 2020 (JP) ..... JP2020-100670

(51) Int. Cl.
*G03G 21/18* (2006.01)
*B41J 2/175* (2006.01)
*G03G 15/08* (2006.01)

(52) U.S. Cl.
CPC ..... *G03G 21/1878* (2013.01); *B41J 2/1753* (2013.01); *B41J 2/17559* (2013.01); *G03G 15/0863* (2013.01); *G03G 2215/0855* (2013.01)

(58) Field of Classification Search
CPC ..... G03G 15/0863
See application file for complete search history.

(56) References Cited

U.S. PATENT DOCUMENTS 6,922,534 B2 * 7/2005 Goto ..... G03G 21/1885 399/12
7,099,607 B2 * 8/2006 Suzuki ..... B29C 65/542 222/DIG. 1
7,205,644 B2 * 4/2007 Kuo ..... B82Y 10/00 257/E23.176

FOREIGN PATENT DOCUMENTS

JP 2003330335 A 11/2003
JP 2005031652 A 2/2005
JP 2018109732 A 7/2018

* cited by examiner

*Primary Examiner* — Leon W Rhodes, Jr.
(74) *Attorney, Agent, or Firm* — Canon U.S.A., Inc., IP Division

(57) ABSTRACT

A cartridge detachably attachable to an apparatus body of an image forming apparatus that forms an image on a recording medium in which a memory unit is fixed by an inexpensive adhesive member that can control adhesion force. The cartridge includes: a memory; and a memory support member that supports the memory. The memory has a semiconductor device storing information related to a cartridge, a sealing material that protects the semiconductor device, and a cartridge electrical contact configured to be electrically connectable to a body electrical contact of the image forming apparatus body for transferring information on the semiconductor device to the image forming apparatus body. The sealing material and the memory support member contain the same type of a thermoplastic resin, the sealing material and the memory support member have bonding faces, and at least parts of the bonding faces are welded and fixed by a solvent.

10 Claims, 11 Drawing Sheets

CARTRIDGE AND MANUFACTURING METHOD OF CARTRIDGE

BACKGROUND OF THE INVENTION

Field of the Invention

The present disclosure relates to a cartridge provided in a detachable manner to an apparatus body of an image forming apparatus that forms an image on a recording medium and a manufacturing method of a cartridge.

Description of the Related Art

Conventionally, in an image forming apparatus using an electro-photographic image forming process, a process cartridge system in which an electro-photographic photosensitive drum and a process unit that works on the electro-photographic photosensitive drum are integrated into a cartridge is employed. This cartridge is detachably attachable to an image forming apparatus body. According to such a process cartridge system, since the user is able to perform maintenance of an image forming apparatus by himself/herself without relying on a service man, operability can be significantly improved. Thus, such process cartridge systems are widely used for image forming apparatuses.

As disclosed in Japanese Patent Application Laid-Open No. 2003-330335, a product in which a memory unit (storage unit) that stores various service information or process information is mounted in a process cartridge has been realized in recent years. The image forming apparatus body makes use of memory information in the process cartridge and thereby further improves image quality or maintenance of a process cartridge. Japanese Patent Application Laid-Open No. 2018-109732 discloses that a memory unit is attached to a bearing face of a cartridge frame by an adhesive agent, a double-sided tape, or the like. Japanese Patent Application Laid-Open No. 2005-31652 discloses that components formed of a styrene-based resin are bonded by welding and fixing using a terpene-based solvent.

SUMMARY OF THE INVENTION

One aspect of the present disclosure is to provide a cartridge that is detachably attachable to an apparatus body of an image forming apparatus and to which a memory unit is fixed by an inexpensive adhesive member whose adhesive force is controllable. The expression "adhesive force is controllable" means that a site to be adhered is distinct and adhesive force can be estimated from the area of the site or the like. Further, another aspect of the present disclosure is to provide a manufacturing method of a cartridge that is detachably attachable to an apparatus body of an image forming apparatus and to which a memory unit is fixed by an inexpensive adhesive member having controllable adhesive force.

To achieve the above aspects, according to one aspect of the present disclosure, provided is a cartridge provided in a detachably attachable manner to an apparatus body of an image forming apparatus that forms an image on a recording medium, and the cartridge includes: a memory; and a memory support member that supports the memory, the memory has a semiconductor device that stores information related to a cartridge, a sealing material that protects the semiconductor device, and a cartridge electrical contact configured to be electrically connectable to a body electrical contact of the apparatus body in order to transfer information on the semiconductor device to the image forming apparatus body. The sealing material and the memory support member contain the same type of a thermoplastic resin, the sealing material and the memory support member have bonding faces, and at least parts of the bonding faces are welded and fixed by a solvent. Further, another aspect of the present disclosure, provided is a manufacturing method of the cartridge as described above, and the manufacturing method includes welding and fixing the sealing material and the memory support member by using a solvent.

According to one aspect of the present disclosure, it is possible to provide a cartridge that is detachably attachable to an apparatus body of an image forming apparatus and to which a memory unit is fixed by an inexpensive adhesive member having controllable adhesive force. Moreover, by providing the adhesive member having controllable adhesive force, it is possible to ensure stable adhesive strength. That is, the quality is stabilized. Further, according to another aspect of the present disclosure, it is possible to provide a manufacturing method of a cartridge that is detachably attachable to an apparatus body of an image forming apparatus and to which a memory unit is fixed by an inexpensive adhesive member having controllable adhesive force.

Further features of the present disclosure will become apparent from the following description of exemplary embodiments with reference to the attached drawings.

DESCRIPTION OF THE EMBODIMENTS

Figure 1:
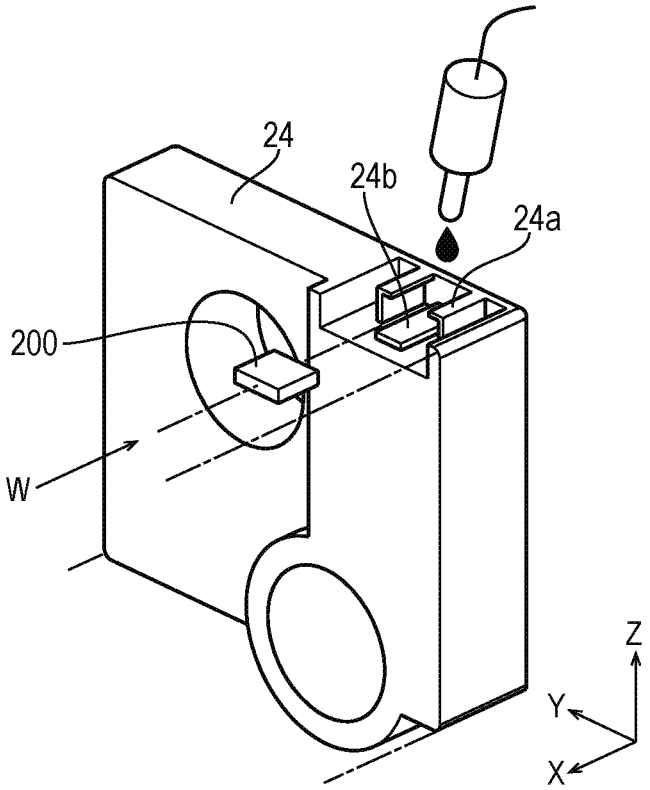
FIG. 1 is an exploded perspective view of a main portion of a cartridge according to an embodiment.

The image forming apparatus as used herein refers to a unit that forms an image on a recording medium. Specifically, the image forming apparatus is an apparatus that forms an image on a recording medium by using an electro-photographic image forming system, for example. An example of the electro-photographic image forming apparatus may include, for example, an electro-photographic copying machine, an electro-photographic printer (for example, a laser printer, an LED printer, or the like), a facsimile machine, a word processor, and a multifunction peripheral thereof (multifunction printer or the like).

Further, an example of the electro-photographic image forming apparatus may include an ink-jet printer using ink supplied from an ink cartridge. Furthermore, an example of the electro-photographic image forming apparatus may include a typewriter, a dot-impact printer, or a thermal transfer printer using an ink ribbon.

Description will be provided below with an electro-photographic image forming system as an example. Further, a cartridge is a unit product that forms an image on a recording medium and has a toner in a case of the electro-photographic system, ink in a case of an ink-jet system, or ink in a case of a system using an ink ribbon. As described previously, description will be provided with a cartridge of an electro-photographic image forming apparatus as an example.

Preferred embodiments of the present disclosure will now be described in detail in accordance with the accompanying drawings.

A cartridge according to an embodiment of the present disclosure and an image forming apparatus using the cartridge will be described below with reference to the drawings. In the following embodiment, a full-color electro-photographic image forming apparatus to which four process cartridges are detachably attachable will be illustrated as the electro-photographic image forming apparatus. Further, in the embodiment described below, a printer is illustrated as an example of an aspect of the image forming apparatus. However, the present disclosure is not limit thereto. For example, the present disclosure is also applicable to another image forming apparatus such as a copying machine, a facsimile apparatus, or the like, a multifunction peripheral combining the functions thereof, or the like.

General Configuration of Image Forming Apparatus

First, an image forming apparatus 1 according to the present embodiment will be described with reference to a schematic sectional view of FIG. 2. The image forming apparatus 1 is a four-color full-color laser printer using an electro-photographic process and performs color image formation on a recording medium S based on image information (electric image signal) input from an external host apparatus 300 to a control circuit unit (control unit) 100. The external host apparatus 300 is a personal computer, an image reader, a facsimile, a network, or the like.

The image forming apparatus 1 is of a process cartridge system that forms an image on a recording medium in a state where a cartridge contributing to an image forming process is loaded in a detachable manner. The image forming apparatus 1 of the present embodiment is to form a color image on the recording medium S with four process cartridges P (PY, PM, PC, PK; hereafter, referred to as a cartridge) being loaded to an apparatus body 2 in a detachable manner.

Herein, with respect to the image forming apparatus 1, a side provided with an apparatus closure door 3 is defined as a front face, and a side opposite to the front face is defined as back face (rear face). Further, the right side when viewed from the front face of the image forming apparatus 1 is defined as a driving side, and the left side is defined as a non-driving side. The four cartridges P, namely, a first cartridge PY, a second cartridge PM, a third cartridge PC, and a fourth cartridge PK are arranged in the horizontal direction inside the apparatus body 2. Respective cartridges P have the same electro-photographic process mechanism and contain respective different colors of developers (hereafter, referred to as a toner). Rotational drive force is transferred to each cartridge P from a drive output unit (not illustrated) of the apparatus body 2. Further, a bias voltage (a charging bias, a developing bias, or the like) is supplied to each cartridge P from a bias output unit (not illustrated) of the apparatus body 2.

Figure 3:
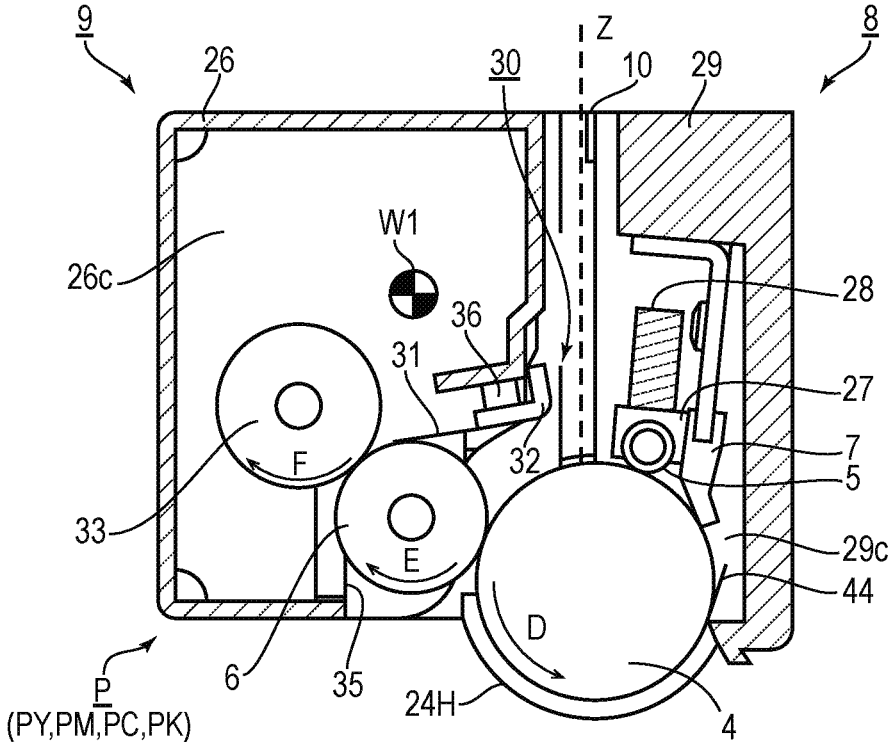
FIG. 3 is a schematic transverse sectional view of the cartridge.

Each cartridge P is an integrated process cartridge. As illustrated in FIG. 3, each cartridge P has a cleaning unit 8 and a developing device 9. The developing device 9 is coupled to the cleaning unit 8 slidably about a shaft W1. The cleaning unit 8 has a drum-type electro-photographic photosensitive member (hereafter, referred to as a photosensitive drum) 4 as a rotatable image carrier on which a latent image is formed, a charging unit 5 as a process unit that works on the photosensitive drum 4, and a cleaning component 7. As the charging unit 5, a charging roller that is a contact charging member is used. As the cleaning component 7, a cleaning blade is used.

The developing device 9 is a contact developing device using a single-component nonmagnetic developer (hereafter, referred to as a toner), and a developer carrier (hereafter, referred to as a developing roller) as a developing unit 6 is arranged to a developing frame 26. The developing frame 26 has a developer containing chamber (developer containing portion) 26*c*, and a toner is contained therein. The first cartridge PY contains a yellow (Y)-color toner in the developer containing chamber 26*c* and forms a Y-color toner image on the surface of the photosensitive drum 4. The second cartridge PM contains a magenta (M)-color toner in the developer containing chamber 26*c* and forms an M-color toner image on the surface of the photosensitive drum 4. The third cartridge PC contains a cyan (C)-color toner in the developer containing chamber 26*c* and forms a C-color toner image on the surface of the photosensitive drum 4. The fourth cartridge PK contains a black (K)-color toner in the developer containing chamber 26*c* and forms a K-color toner image on the surface of the photosensitive drum 4.

A laser scanner unit LB as an exposure unit is provided above the four cartridges P. The laser scanner unit LB outputs laser light Z in association with image information. The laser light Z then passes through an exposure window 10 of the cartridge P to scan and expose the surface of the photosensitive drum 4. Further, an intermediate transfer belt unit 11 as a transfer member is provided below the four cartridges P. The intermediate transfer belt unit 11 has a drive roller 13, a turn roller 14, and a tension roller 15, and a flexible endless transfer belt 12 is hung therearound.

The under face of the photosensitive drum 4 of each cartridge P is in contact with the upper face of the transfer belt 12. The contact portion is a primary transfer portion. Inside the transfer belt 12, a primary transfer roller 16 is provided facing the photosensitive drum 4. A secondary transfer roller 17 is in contact with the turn roller 14 via the transfer belt 12. The contact portion between the transfer belt 12 and the secondary transfer roller 17 is a secondary transfer portion.

A feed unit 18 is provided under the intermediate transfer belt unit 11. The feed unit 18 has a sheet feed tray 19 in which the recording media S are stacked and contained and a sheet feed roller 20. A fixing unit 21 and a discharge unit 22 are provided in the left-upper part (upper on the back side) inside the apparatus body 2 in FIG. 2. The upper face of the apparatus body 2 serves as a discharge tray 23. An unfixed toner image is fixed as a fixed image on the recording medium S by a fixing unit provided in the fixing unit 21, and the recording medium S is discharged as an image-formed material to the discharge tray 23. A recording medium conveying path from the feed unit 18 to the discharge unit 22 is a conveyance unit that conveys a recording medium.

Image Forming Operation

The operation for forming a full-color image is as follows. The photosensitive drum 4 of each cartridge P is driven to rotate at a predetermined rate (in the arrow D direction in FIG. 3, anticlockwise in FIG. 2). The transfer belt 12 is also driven to rotate at a rate corresponding to the rate of the photosensitive drum 4 in a forwarding direction (in the arrow C direction in FIG. 2) with respect to the rotation of the photosensitive drum 4. The laser scanner unit LB is also driven.

In synchronization with the driving of the laser scanner unit LB, the charging roller 5 charges the surface of the photosensitive drum 4 evenly in a predetermined polarity and potential in each cartridge P. The laser scanner unit LB scans and exposes the surface of each photosensitive drum 4 with the laser light Z in accordance with an image signal for the corresponding color. Accordingly, an electrostatic latent image in accordance with the image signal of the corresponding color is formed on the surface of each photosensitive drum 4.

Figure 2:
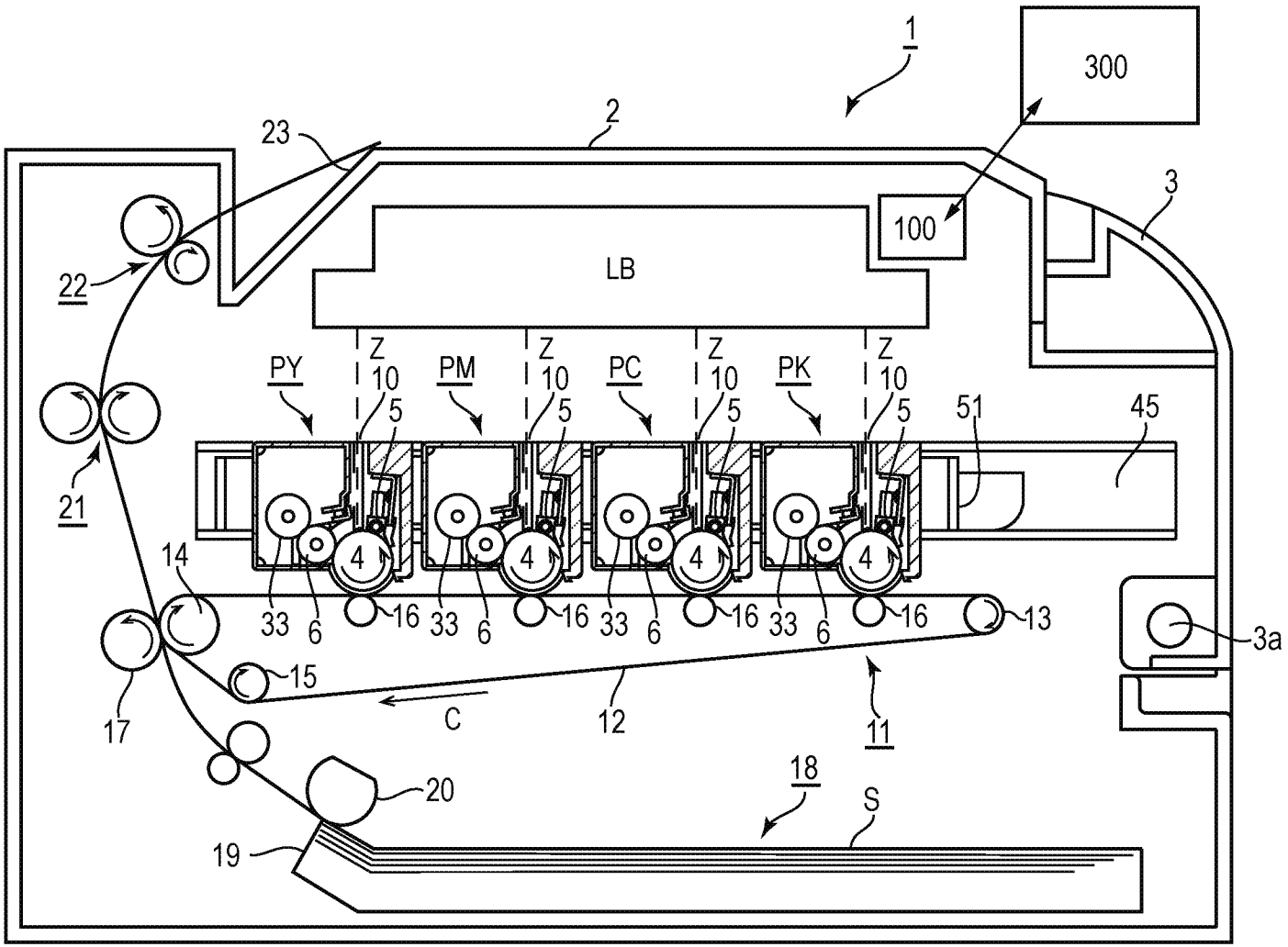
FIG. 2 is a schematic sectional view of an image forming apparatus according to the embodiment.

The electrostatic latent image is developed as a toner image by the developing roller 6 driven to rotate at a predetermined rate (in the arrow E direction in FIG. 3, clockwise in FIG. 2). With the electro-photographic image forming process operation as described above, a Y-color toner image corresponding to the Y-color component of a full-color image is formed on the photosensitive drum 4 of the first cartridge PY. This toner image is primarily transferred onto the transfer belt 12. An M-color toner image corresponding to the M-color component of the full-color image is formed on the photosensitive drum 4 of the second cartridge PM. This toner image is overlapped on the Y-color toner image, which has already been transferred, and primarily transferred onto the transfer belt 12.

Further, a C-color toner image corresponding to the C-color component of the full-color image is formed on the photosensitive drum 4 of the third cartridge PC. This toner image is overlapped on the Y-color and M-color toner images, which have already been transferred, and primarily transferred onto the transfer belt 12. A K-color toner image corresponding to the K-color component of the full-color image is formed on the photosensitive drum 4 of the fourth cartridge PK. This toner image is overlapped on the Y-color, M-color, and C-color toner images, which have already been transferred, and primarily transferred onto the transfer belt 12. In such a way, a full-color unfixed overlapped transfer toner image with four colors, namely, the Y-color, the M-color, the C-color, and the K-color is formed on the transfer belt 12.

On the other hand, the recording medium S is separated one by one and fed at a predetermined control timing from the feed unit 18. The recording medium S is introduced into the secondary transfer portion that is the contact portion between the secondary transfer roller 17 and the transfer belt 12 at a predetermined timing. Accordingly, the toner images with the four colors being overlapped on the transfer belt 12 are sequentially and collectively secondarily transferred on the surface of the recording medium S during a process of the recording medium S being pressed and conveyed by the secondary transfer portion. The recording media S subjected to the secondary transfer of the toner image is then introduced into the fixing unit 21, subjected to a fixing process, and discharged to the discharge tray 23 as a full-color image-formed material.

Configuration of Cartridge P

Figure 4:
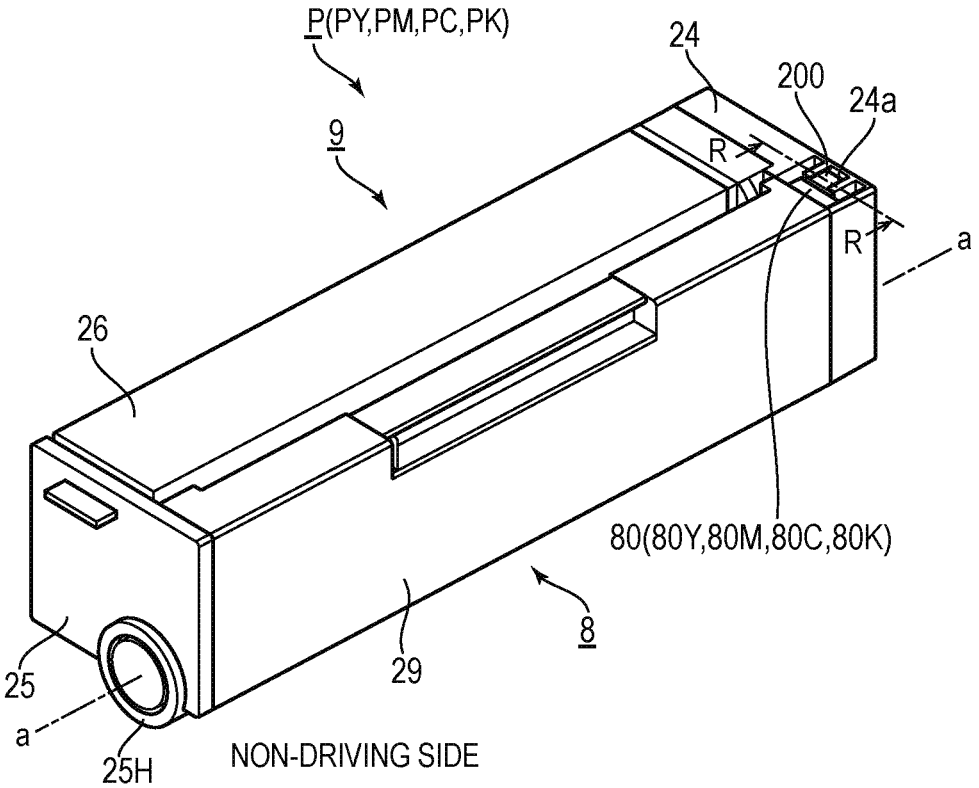
FIG. 4 is an external perspective view of the cartridge when viewed from a non-driving side.
Figure 5:
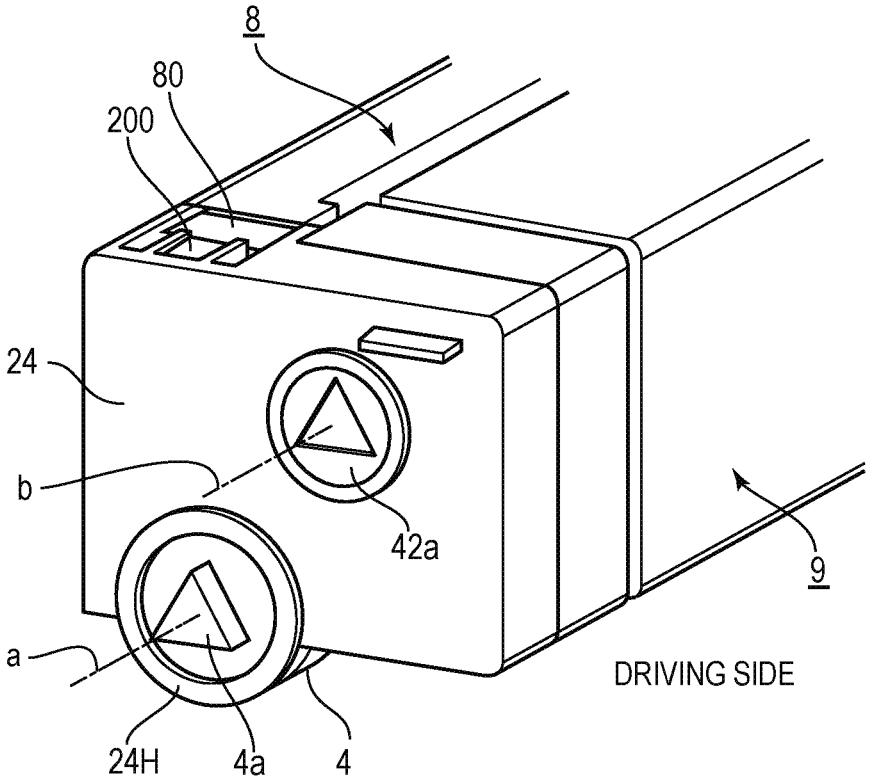
FIG. 5 is a perspective view of a driving side portion of the cartridge.
Figure 6:
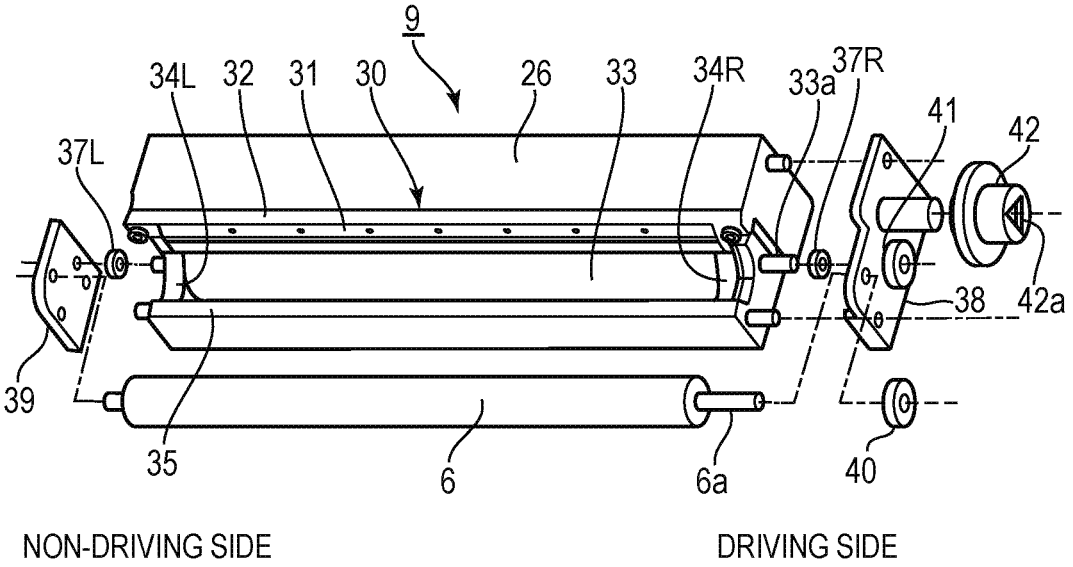
FIG. 6 is an exploded perspective view of a developing device.

Next, the configuration of the cartridge P will be described. Respective cartridges P have the same electrophotographic process mechanism and contain toners of respective different colors. FIG. 3 is a schematic sectional view of the cartridge P. FIG. 4 is a perspective view of the cartridge P when viewed from the non-driving side, FIG. 5 is a perspective view of a driving side portion of the cartridge P, and FIG. 6 is an exploded perspective view of the developing device 4. The cartridge P has a laterally long shape having the longitudinal direction in a direction of the rotation axis line a of the photosensitive drum 4 and has the cleaning unit 8, the developing device 9, a driving side cover member 24, and a non-driving side cover member 25.

1) Configuration of Cleaning Unit 8

As illustrated in FIG. 3, the cleaning unit 8 is formed of a cleaning container 29 having the photosensitive drum 4, the charging roller 5, and a cleaning blade 7. The photosensitive drum 4 is rotatably supported by a bearing 24H on the driving side cover member 24 side and a bearing 25H on the non-driving side cover member 25 side. Further, a driving output coupling (not illustrated) on the apparatus body 2 side is engaged to the drum drive coupling 4*a* (FIG. 5) on the driving side cover member 24 side, and thereby the photosensitive drum 4 obtains driving force of a motor (not illustrated) and is driven to rotate in the arrow D direction in FIG. 3.

The cleaning container 29 functions as a frame used for holding the charging roller 5 as a process unit for image formation and the cleaning blade 7. The charging roller 5 is rotatably supported at both ends by a charging roller bearing 27 on the driving side and the non-driving side of the cleaning container 29, comes into contact with the surface of the photosensitive drum 4 and is rotated accordingly, and supplied with a charging bias to charge the surface of the photosensitive drum 4. At this time, to evenly charge the surface of the photosensitive drum 4, both the ends of the charging roller 5 are pressed against the surface of the photosensitive drum 4 by a pressing spring 28.

The cleaning blade 7 is fixed to the cleaning container 29 and provided such that an elastic rubber portion at the edge comes into contact with the photosensitive drum 4 in a counter direction to the rotation direction (the arrow D direction in FIG. 3) of the photosensitive drum 4. When an image is formed, the cleaning blade 7 wipes a residual transfer toner remaining on the photosensitive drum 4 to clean up the surface of the photosensitive drum 4. At this time, to sufficiently wipe off the residual transfer toner, the edge of the cleaning blade 7 is in contact with the surface of the photosensitive drum 4 with a predetermined pressure.

Further, the residual transfer toner wiped from the surface of the photosensitive drum 4 by the cleaning blade 7 is contained in a waste toner containing portion 29*c* of the cleaning container 29 as a waste toner. Thus, in the cleaning container 29, a waste toner collection sheet member 44 used for preventing the waste toner from leaking out from a gap with the photosensitive drum 4 or the cleaning blade 7 is fixed to the photosensitive drum 4 in the longitudinal direction. Further, cleaning blade end seal members (not illustrated) are provided at both ends in the longitudinal direction of the cleaning blade 7.

2) Configuration of Developing Device 9

The configuration of the developing device 9 will be described with reference to FIG. 3 and FIG. 6. The developing device 9 has a laterally long shape having the longitudinal direction in a direction of the rotation axis line of the developing roller (developer carrier) 6 as the developing unit. The developing device 9 is formed of the developing frame 26, a developing blade 31, a developer supply roller 33, developing end seal members 34R and 34L, a flexible sheet member 35, supply roller shaft seals 37R and 37L, and the like in addition to the developing roller 6.

Further, a developing roller gear 40 and a supply roller gear 41 are arranged to the driving side ends of a core material (core metal) 6*a* of the developing roller 6 and a core material (core metal) 33*a* of the developer supply roller 33, respectively, and are engaged with a developing drive input gear 42. The developing drive input gear 42 has a developing drive coupling 42*a*. A drive output coupling (not illustrated) on the apparatus body 2 side is engaged with the developing drive coupling 42*a* (FIG. 5, FIG. 6), and drive force of a drive motor (not illustrated) is transferred to the apparatus body 2. Accordingly, the developing roller 6 and the developer supply roller 33 are driven to rotate at predetermined rates (in the arrow E direction and the arrow F direction in FIG. 3).

The developing blade 31 is a metal thin plate having elasticity and having a thickness of about 0.1 mm, which is a member that is long in the direction of the rotation axis line of the developing roller 6. The developing blade 31 is supported by a support plate metal 32, and the support plate metal 32 is attached to the developing frame 26. The developing blade unit 30 is formed of the developing blade 31 and the support plate metal 32. The free end in the shorter direction of the developing blade 31 is in contact with the developing roller 6 in the counter direction to the rotation direction (the arrow E direction in FIG. 3) of the developing roller 6. A developing blade under-seal 36 is arranged so as to fill the gap in the entire longitudinal extent between the developing frame 26 and the developing blade unit 30 and prevents toner leakage.

As illustrated in FIG. 6, the developing end seal members 34R and 34L are arranged at both ends of the opening of the developing frame 26 and prevent toner leakage from the gap between the developing blade 31 and the developing frame 26 and between the developing roller 6 and the developing frame 26. Further, the flexible sheet member 35 is arranged on the longitudinal direction side that is the opposite side of the developing blade 31 in the opening of the developing frame 26 so as to come into contact with the developing roller 6 and prevents toner leakage from the gap between the developing frame 26 and the developing roller 6. Further, the supply roller shaft seals 37R and 37L are mounted on portions exposed outside the developing frame 26 in the core material 33*a* of the developer supply roller 33 and prevent toner leakage from the gap between the core penetration hole provided in the developing frame 26 and the core material 33*a*. The developing device 9 is slidably supported by the shaft W1 between the driving side cover member 24 and the non-driving side cover member 25. That is, the cleaning unit 8 and the developing device 9 are coupled to each other via the shaft W1. Further, the developing device 9 is pushed and revolved about the shaft W1 by a pushing member (not illustrated) in a free state so that the developing roller 6 is in contact with the photosensitive drum 4 on the cleaning unit 8 side at predetermined pressing force. The developing drive coupling 42*a* is arranged coaxially with the axis line b of the shaft W1.

The cleaning unit 8 is positioned and fixed to a positioning portion on the apparatus body side in a state where each cartridge P is loaded in place into the loading portion of the apparatus body 2. The developing device 9 is in a free state when the image forming apparatus forms an image. That is, the developing roller 6 is pushed and revolved about the shaft W1 by a pushing member so as to be in contact with the photosensitive drum 4 on the cleaning unit 8 side at predetermined pressing force.

Then, when an image is formed, the developer supply roller 33 and the developing roller 6 are driven and rotated to slide, and thereby the toner in the developer containing chamber 26*c* is carried on the developing roller 6. The developing blade 31 restricts the thickness of a toner layer formed on the circumferential surface of the developing roller 6 and provides the charges caused by friction charging with the developing roller 6 to the toner by a contact pressure. The charged toner on the developing roller 6 is then attached to an electrostatic latent image on the photosensitive drum 4 at the contact portion between the developing roller 6 and the photosensitive drum 4, and a latent image is developed. Further, when the image forming apparatus is not forming an image, the developing device 9 is held at a position revolved about the shaft W1 against the pushing member by an acting member (not illustrated) on the apparatus body side in a direction in which the developing roller 6 is separated away from the photosensitive drum 4.

Attachment/Detachment Configuration of Cartridge P to/from Apparatus Body 2

The attachment/detachment operation of each cartridge P (PY, PM, PC, PK) to/from the apparatus body 2 will be described with reference to FIG. 2 and FIG. 8. FIG. 2 illustrates a state where a drawing unit 51 has been moved to a loading position to load each cartridge P into the apparatus body 2 and the apparatus closure door 3 is closed. In the image forming apparatus of the present embodiment, a system in which the user places each cartridge on the drawing unit (cartridge tray) 51 and replaces the cartridge via front access is employed for replacement of each cartridge. The drawing unit 51 supports each cartridge P in a detachably attachable manner. The drawing unit 51 is configured to be linearly movable (pushed in/drawn from) between the drawn position where the cartridge P can be attached and detached outside the apparatus body 2 and the loading position where the cartridge P is loaded inside the apparatus body 2 with respect to a rail member 45.

Figure 8:
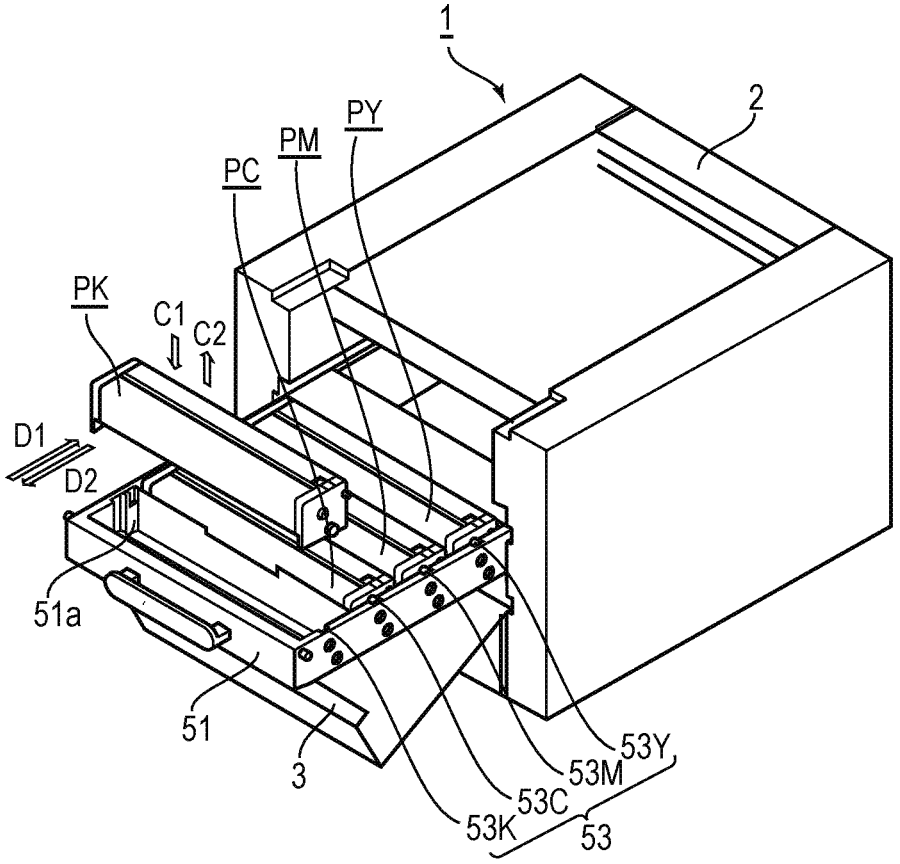
FIG. 8 is a diagram illustrating attachment-detachment configuration with respect to an apparatus body of a cartridge.

FIG. 8 illustrates a state where the apparatus closure door 3 is opened and the drawing unit 51 has been moved to the drawn position where each cartridge P can be attached and detached outside the apparatus body 2. The arrow D2 represents a drawing motion direction of the drawing unit 51, and the arrow D1 represents a pushing motion direction of the drawing unit 51. The drawing motion direction D2 and the pushing motion direction D1 of the drawing unit 51 are substantially the horizontal direction.

The loading operation of each cartridge P to the apparatus body 2 will be described. The user revolves the apparatus closure door 3 about a hinge shaft 3*a* to open the apparatus closure door 3. The user then draws and moves the drawing unit 51 in the apparatus body 2 to be located in the drawn position where each cartridge P can be attached and detached outside the apparatus body 2. Herein, connection of the drive output unit on the apparatus body side to the drum drive coupling 4*a* and the developing drive coupling 42*a* of each cartridge P is released along with the opening motion of the apparatus closure door 3. Pushing of the cleaning unit 8 against on a positioning portion (not illustrated) on the apparatus body side in each cartridge P is released. Further, connection of the bias output portion on the apparatus body side to each cartridge P is released. Further, connection of body's electrical contacts to electrical contacts 200*a* and 200*b* of the memory 200 in each cartridge P is released.

Further, the photosensitive drum 4 of each cartridge P and the transfer belt 12 are separated from each other by the motion of the rail member 45 or the intermediate transfer belt unit 11. In this state, it is possible to move the drawing unit 51 from the loading position in the apparatus body 2 to the drawn position. In the state where the drawing unit 51 has been moved to the drawn position, it is possible to detach and attach and thus replace the cartridge P with respect to the drawing unit 51. That is, the cartridge P is taken out of the drawing unit 51 in the arrow C2 direction, loaded into the cartridge tray 43 from the arrow C1 direction (substantially the gravity direction), and held.

Respective cartridges P are aligned in the motion direction such that the longitudinal direction thereof (direction of the axis line of photosensitive drum 4) is a direction orthogonal to the motion direction of the drawing unit 51. Further, four cartridge loading portions 51*a* into which the four cartridges P (PY, PM, PC, PK) are loaded are aligned in a line in the drawing unit 51. Further, body color display labels 53 (53Y, 53M, 53C, 53K) that are different in accordance with the toner color of the cartridge P to be loaded are provided at the ends of the four cartridge loading portions 51*a*.

The body color display labels 53 correspond to color display members 80 provided to the first to fourth cartridges, respectively. Specifically, as illustrated in FIG. 8, the color display member 80 and the body color display label 53 labeled with the same indication in accordance with the toner color are provided to a cartridge P containing a toner of a predetermined color and the cartridge loading portion 51*a* into which the cartridge P is loaded.

Accordingly, when loading the cartridge P into a new apparatus body 2 or when replacing the cartridge P due to the end of life of the cartridge P, the user views and recognizes the color display member 80 and the body color display label 53 provided to the front face of the cartridge loading portion 51*a*. Then, by confirming that the color display member 80 and the body color display label 53 are matched, the user is able to correctly load the cartridge P into the corresponding cartridge loading portion 51*a*.

On the other hand, when the color display member 80 and the body color display label 53 are not matched, since it can be visually recognized that the cartridge P is erroneously inserted, erroneous insertion of the cartridge P in the cartridge loading portion 51*a* can be prevented. Note that, even if the cartridge P should be forcedly inserted in a wrong place, the cartridge P or the apparatus body 2 is not damaged because neither a protrusion nor a notch for identification is provided to the cartridge P or the cartridge loading portion 51*a*.

After an operation of replacing old one with new one for a necessary cartridge P corresponding to a predetermined cartridge loading portion 51*a* of the drawing unit 51, the user fully pushes and moves the drawing unit 51 into the apparatus body 2. The user then closes the apparatus closure door 3. Herein, the photosensitive drum 4 of each cartridge P and the transfer belt 12 come into contact with each other due to motion of the rail member 45 or the intermediate transfer belt unit 11 along with the closing motion of the apparatus closure door 3. The cleaning unit 8 is pushed against a positioning portion (not illustrated) on the apparatus body side in each cartridge P. The drum drive coupling 4*a* and the developing drive coupling 42*a* of each cartridge P on the apparatus body side are connected to each other.

Further, the bias output portion on the apparatus body side is connected to each cartridge P. Further, the body's electrical contacts are connected to the electrical contacts 200*a* and 200*b* of the memory 200 in each cartridge P. Accordingly, each cartridge P has been loaded in a predetermined loading position to the apparatus body 2, and the image forming apparatus 1 is ready for the image forming operation.

3) Memory

The memory 200 storing information such as a lot number of the cartridge P, characteristics of the image forming apparatus, characteristics of a process unit, and the like is provided to each cartridge P. Further, the color display members 80 (80Y, 80M, 80C, 80K) are provided (see FIG. 4) so that the color display members 80 can be identified, respectively, in accordance with the type such as a toner color contained in the cartridge P.

The body's electrical contact (contact member) on the apparatus body side is electrically connected to the electrical contact (cartridge electrical contact) on the memory 200 side in a state where each cartridge P is loaded in place into the loading portion in the apparatus body 2. This enables transfer of information between a control circuit unit 100 on the apparatus body 2 side and the memory 200 on the cartridge P side. The control circuit unit 100 transfers information stored in the memory 200 to recognize the status such as the use status of the cartridge P and control image formation in accordance with the information. Accordingly, image formation is performed in a suitable condition.

Figure 7A:
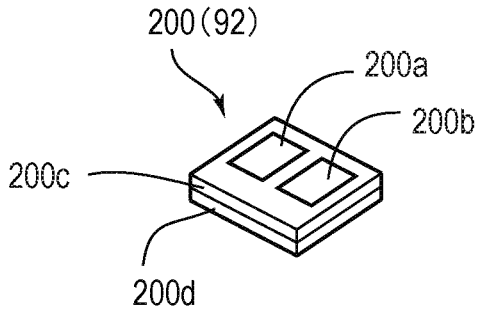
FIG. 7A is an external perspective view of a memory.
Figure 7B:
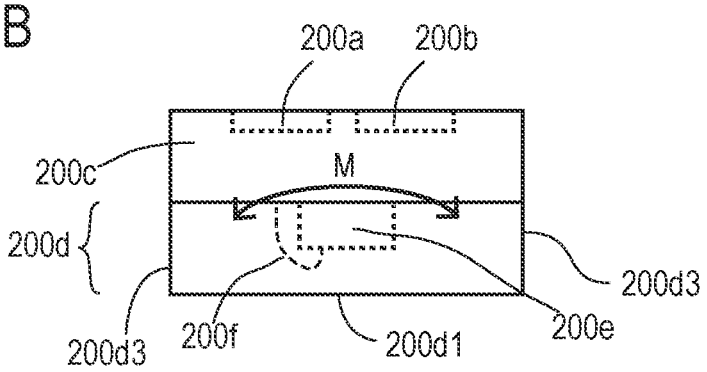
FIG. 7B is an external side view of the memory.

FIG. 7A is an external perspective view of the memory 200 in the present embodiment. FIG. 7B is a side view. The memory 200 is formed of a substrate 200*c* holding a semiconductor device 200*e*, a pair of cartridge electrical contacts 200*a* and 200*b*, and a sealing material 200*d* formed to cover the surface of the semiconductor device 200*e* and the substrate 200*c*. Further, the memory 200 is attached to a memory support portion (a memory support component) 24*a* described later provided to the driving side cover member 24.

That is, the memory 200 has the cartridge electrical contacts 200*a* and 200*b* that can be electrically connected to body's electrical contacts (not illustrated) of the apparatus body 2 in order to transfer information related to a process unit of the cartridge P to the control circuit unit 100 of the apparatus body 2. The cartridge electrical contacts 200*a* and 200*b* are electrically connected to the body's electrical contacts (not illustrated) on the apparatus body 2 side when the cartridge P is loaded into the apparatus body 2. Further, information stored in the memory 200 is transferred to the control circuit unit on the apparatus body 2 side via the body's electrical contacts. The memory 200 is attached to the memory support portion 24*a* such that the cartridge electrical contacts 200*a* and 200*b* face the outside. The sealing material 200*d* will be described in detail with reference to FIG. 1, FIG. 7A, and FIG. 7B.

Conventional Art

Conventionally, a sealing material is formed to cover the substrate 200*c* and the semiconductor device 200*e* for the purpose of protecting the semiconductor device 200*e* storing information. It is common to employ resin sealing as a forming method in terms of productivity, cost, or the like, and a sealing molding material using a thermosetting resin is used. The sealing molding material is often tableted and molded in a cylindrical tablet. It is common to use a transfer molding method or the like by using such a tablet.

As a sealing material, those based on a mixture of silica that is an inorganic filler and an epoxy resin that is a thermosetting resin have been the mainstream so far. The sealing material is required to be durable against a use environment and superior in heat resistance and have a suppressed warp of the memory after molding. Thus, in the sealing material, a linear expansion coefficient, a moldability (viscosity), strength, or the like are required to be controlled. As described above, a general sealing material is prescribed to contain 90 parts by mass of silica and 10 parts by mass of an epoxy resin in 100 parts by mass of a sealing material.

Figure 22:
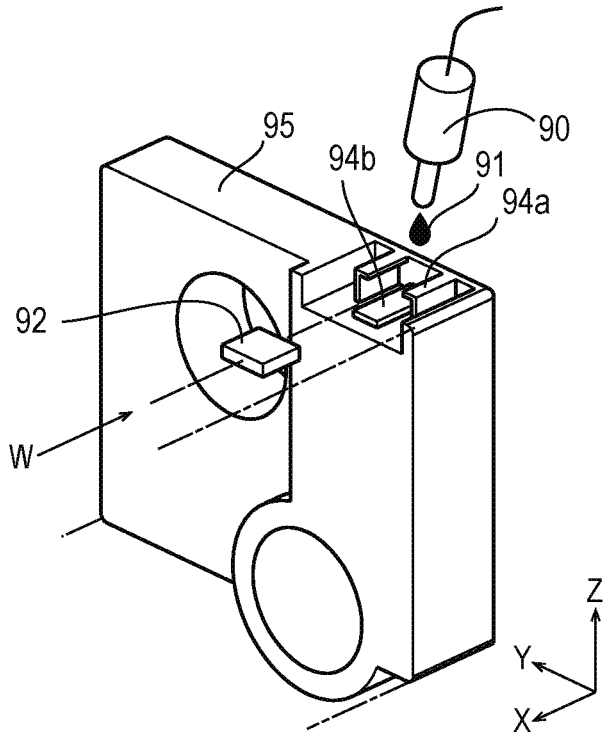
FIG. 22 is an exploded perspective view of a primary portion of a conventional cartridge.

As illustrated in FIG. 22, a conventional memory 92 is fixed to a cover member 95, which is a memory support member, by an adhesive agent 91 applied from an adhesive agent application device 90, a double-sided tape, or the like. For the cover member 95, a thermoplastic resin is used, among others, a material formed of a resin containing polystyrene is used in terms of superiority in cost and moldability.

Present Disclosure

A cartridge of the present disclosure has a memory and a memory support member that supports the memory. The memory has a semiconductor device that stores information related to a cartridge, a sealing material that protects the semiconductor device, and a cartridge electrical contact configured to be electrically connectable to a body electrical contact of the image forming apparatus body in order to transfer information on the semiconductor device to the image forming apparatus body. Further, the sealing material and the memory support member contain the same type of thermoplastic resin. The sealing material has a bonding face to bond to the memory support member, and at least a part of the bonding face is welded and fixed by a solvent.

The sealing material 200*d* contains the same type of thermoplastic resin as at least one type in the prescribed materials forming the cover member 24 or at least one type in the prescribed materials forming a part of the surface of the cover member 24. A resultant part of the surface due to two-color molding (double molding) or molding, embedding, or attachment of a different member is included in "a part of the surface". When the same type of thermoplastic resin as at least one type in the prescribed materials forming the cover member 24 or the like is included in the sealing material 200*d*, it is possible to use a solvent that dissolves both the sealing material of the memory and the memory support member (cover member) when integrating them. This enables strong bonding when both or one of the sealing material and the memory support member is dissolved and assembled and thereby integrated. Alternatively, with the solvent being applied in an assembled state, both members (the sealing member and the memory support member) containing the same type of thermoplastic resin described above can also be dissolved and integrated. Such dissolving integration will be described in more detail.

—Material of Sealing Material—

The process of selecting a thermoplastic resin will be described. As described previously, as a frame material of a cartridge that is a consumable, high-impact polystyrene (hereafter, referred to as HIPS) mainly containing polystyrene is employed. Although a cartridge employing HIPS will be described below, a thermoplastic resin such as polypropylene (PP), polyethylene (PE), polyphenylene oxide (PPO), polycarbonate (PC), polyethylene terephthalate (PET), or the like may be employed. For a cartridge whose main material is a thermoplastic resin such as PP, a sealing material containing a thermoplastic resin such as PP can be used. The same type of thermoplastic resin just needs to be contained in each of the sealing material and the memory support member.

In determining a prescription of the sealing material, respective characteristics (heat resistance, countermeasure against warp, melting viscosity) required for the sealing material were reviewed, and the content of polystyrene was determined. A common memory is required to have heat resistance that withstands a reflow process of mounting electronic components on a print substrate and heat resistance that may withstand an environmental temperature during being implemented on a product. As a result, heat resistance to about 145 degrees Celsius is required. For the cartridge according to the present disclosure, however, the use environment temperature is at the highest 60 degrees Celsius, and the reflow process described above is not included even in a manufacturing process of the memory. It is therefore possible to reduce the heat resistance (heat resistant temperature) required for the sealing material, and there is no problem in heat resistance even when polystyrene (glass transition temperature of 90 degrees Celsius) is mixed to the conventional epoxy resin (glass transition temperature of 150 degrees Celsius).

Next, description related to a countermeasure against a warp of the memory required for the sealing material will be provided. Since the linear expansion coefficient of the sealing material 200*d* is larger than that of the substrate 200*c*, a warp occurs as illustrated by the arrow M in FIG. 7B after molding (transfer molding). For the purpose of reducing such a warp, the sealing material is filled with an inorganic filler, and silica is used in general. Further, in the conventional sealing material, it is common that 80 to 90 parts by mass of silica and 10 to 20 parts by mass of an epoxy resin are used for 100 parts by mass of a sealing material. When polystyrene is contained in the conventional sealing material, the ratio of the inorganic filler decreases. Since the linear expansion coefficient of polystyrene is $8\times10^5$ (/K) while the linear expansion coefficient of epoxy is $1.4\times10^5$ (/K), a warp M tends to increase in general as the content of polystyrene increases. Further, a piece of integrated multiple memories that has not been cut into the size described above in the production process may be used as the memory 200 used for a cartridge, and in this case, the size of the memory 200 may be about 5 mm×5.5 mm. In such a case, the content of polystyrene was determined in a range where the content did not affect a cutting process in the subsequent process.

Next, description related to the melting viscosity during molding required for a sealing material will be provided. As illustrated in FIG. 7B, in the memory 200, the semiconductor device 200*e* and the substrate 200*c* are wired by a wire 200*f*. In this state, to mold a sealing material, it is required that the melting viscosity of the sealing material be a viscosity that does not cause deformation or disconnection of the wire. When a styrene-based material is contained in the sealing material, the content (ratio) of silica, which is an inorganic filler, decreases. As the content of silica decreases, the melting viscosity of the sealing material tends to decrease, which is advantageous against deformation or disconnection of the wire. If a styrene-based material is contained, however, the melting viscosity tends to increase. The prescription of the sealing material was determined taking incombustibility, moisture absorption, strength, or the like into consideration in addition to the above points.

Further, to fix the memory 200 to the memory support portion 24*a* by an inexpensive device and an inexpensive adhesive member, the memory support portion 24*a* and the memory 200 contain the same type of thermoplastic resin. When the memory support portion 24*a* is formed of a styrene-based resin, the sealing material of the memory 200 also contains a styrene-based resin. In such a case, it is preferable to use a terpene-based solvent for a solvent intended for adhesion. Specifically, it is preferable to use d-limonene. The adhesion strength increases as the content of polystyrene in the sealing material increases. The prescription of materials was determined taking into consideration of the above required function of the sealing material required for a cartridge.

The required function described previously can be obtained when (A) 40 to 95% by mass of an inorganic filler (silica as an example), (B) 3 to 30% by mass of an epoxy resin, and (C) 2 to 40% by mass of a thermoplastic resin (polystyrene as an example)

are contained with respect to a mass of the sealing material as a reference. In the present implementation, although d-limonene is used as a solvent in order to weld members containing polystyrene-based materials to each other, another solvent may be used as long as the solvent can melt a polystyrene-based resin. When the thermoplastic resin is a resin other than a polystyrene-based resin, the content of the thermoplastic resin can be determined taking the above function required for the sealing material into consideration. Also for the solvent, the use of a solvent that melts a thermoplastic resin enables adhesion of the memory and the memory support member. Note that the expression that a thermoplastic resin contained in the sealing material and a thermoplastic resin contained in the memory support member are of "the same type" means that the types of resins are the same, for example, a styrene-based resin and a styrene-based resin, polyester and polyester, or the like. Further, most preferably, both the thermoplastic resins are polystyrene.

A method of molding sealing material tablets (the material for transfer molding) may be a method of processing a material used for molding the sealing material into a film shape, then crushing the film-shaped material, and molding tablets. When the sealing material is fabricated and molded, a thermoplastic resin, a thermosetting resin, a curing agent, a curing accelerator, an inorganic filler, or the like are measured to be a predetermined blending quantity and preliminarily mixed by using a mixer or the like if necessary. Then, the above materials are heated and kneaded by using a general method of performing kneading by using a mixing roll, an extruder, a mortar machine, or the like, and thereby a powder-like or sheet-like sealing molding material can be prepared. At this time, a solvent may be used for evenly mixing the above materials.

Further, all the ingredients may be added at the same time, however, the addition order can be suitably set. Further, some of the ingredients may be preliminarily kneaded if necessary. For example, an epoxy resin and a curing agent, a curing agent and a curing accelerator, an epoxy resin and/or a curing agent and a mold-releasing agent, an epoxy resin and/or a curing agent and a stress relaxation agent, a filler and a coupling agent, or the like may be preliminarily kneaded at room temperature or under heating and used.

The obtained sealing molding material is molded by a tablet molding machine, and thereby sealing material tablets are manufactured. That is, the sealing molding material is cooled, crushed by a hammer mill or the like if necessary, granulated into a predetermined grain diameter, and then tableted to a size and mass to meet a molding condition in accordance with the purpose of use by using a tablet molding machine. When tableted, the material may be molded by using a mold-releasing agent in order to improve the mold releasability in the tablet molding.

When a mold-releasing agent is used, a mold-releasing agent dissolved in a solvent is supplied to the contact surface between the sealing material and perforations of a tablet molding machine to form a mold-releasing agent layer on the perforated surface. The sealing molding material supplied to the tablet molding machine is then tableted and molded, and thereby sealing material tablets are manufactured. The mold-releasing agent used in the present disclosure is not particularly limited and may be, for example, the followings: a silicone-based mold-releasing agent such as organopolysiloxane whose primary component is dimethylpolysiloxane, a fluorine-based mold-releasing agent such as polytetrafluoroethylene or perfluoroalkyl-containing polymer, an alcohol-based mold-releasing agent such as polyvinyl alcohol, paraffin, a higher fatty acid, a higher fatty acid metal salt, an ester-based wax, a polyolefin-based wax, waxes of polyethylene, polyethylene oxide, or the like, or a polystyrene resin, or the like may be used alone or in combination of two or more types thereof.

The solvent used in the present disclosure is not particularly limited as long as it can dissolve the mold-releasing agent, and a common solvent of hexane, pentane, hydrofluoroether, decafluoropentane, or the like can be used, for example. Even when a working environment for manufacturing the sealing material tablets is at about 20 degrees Celsius, however, the temperature of the tablet molding machine may reach 50 degrees Celsius locally. Thus, the solvent is preferably a nonflammable solvent such as hydrofluoroether, or decafluoropentane in terms of safety or workability. The use of nonflammable solvent enables a reduction of safety devices or a reduction of inspection. Herein, as a nonflammable solvent, a solution which is nonflammable at 20 degrees Celsius is preferable, and a solution which is nonflammable at 50 degrees Celsius or higher is more preferable.

The use ratio between a mold-releasing agent and a solvent is not particularly limited as long as the mold-releasing agent is dissolved in the solvent, and a ratio of the mold-releasing agent to the solvent is preferably 0.01 to 10% by mass, more preferably 0.05 to 5% by mass, and much more preferably 0.1 to 3% by mass in terms of product characteristics. A method of supplying the mold-releasing agent dissolved in the solvent (hereafter, referred to as "mold-releasing agent solution") to the perforated surface of the tablet molding machine and forming a mold-releasing agent layer on the perforated surface is not particularly limited and may be, for example, a method using the following common scheme: application coating such as baking finish, spray coating such as spraying by using a spray nozzle, or the like. The spray coating is preferable in terms of superiority in operability. A mold-releasing agent solution may be mixed to a fluid such as air for performing spray coating. It is preferable to supply the mold-releasing agent solution to the perforated surface intermittently at a suitable interval along with a continuous molding operation of the tablet molding machine.

The thickness of the mold-releasing agent layer formed on the perforated surface is required to be 0.001 to 0.07 μm in terms of obtaining superior mold releasability and avoiding occurrence of appearance defect and is preferably 0.01 to 0.02 μm in terms of obtaining superior mold releasability and adherence. Herein, the thickness of the mold-releasing agent layer means a thickness obtained by one time of the supply process of a mold-releasing agent solution and is found from a measured value or a theoretical value. When found from a theoretical value, the thickness can be calculated from the surface area of perforations, a solvent dilution rate, and a supply amount of the mold-releasing agent. While the mold-releasing agent layer may be formed on a part of the perforated surface, the mold-releasing agent layer is preferably formed on the whole perforated surface in terms of obtaining superior mold releasability and more preferably formed evenly on the perforated surface.

—Method of Fixing Memory—

Figure 10A:
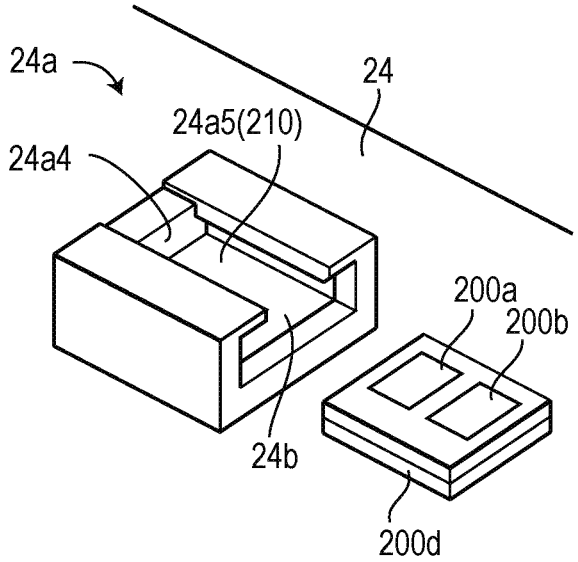
FIG. 10A is a perspective view of a memory and a memory support portion illustrated in FIG. 9A and FIG. 9B.

An attachment method and a fixing method of the memory 200 to the memory support member according to the implementation of the present disclosure will be described in detail with reference to FIG. 10A, FIG. 10B, and FIG. 11. As described previously, the memory 200 is attached on the top face of the driving side cover member 24. The driving side cover member 24 is provided with the memory support portion 24*a* used for supporting the memory 200. In the present implementation, the memory support portion 24*a* is a slit (opening 24*b*) opened in one direction in order to insert the memory 200 therein.

Figure 10B:
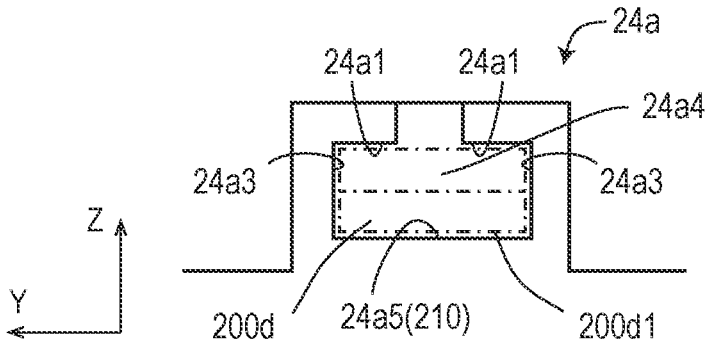
FIG. 10B is a sectional view of the memory support portion illustrated in FIG. 10A.
Figure 11:
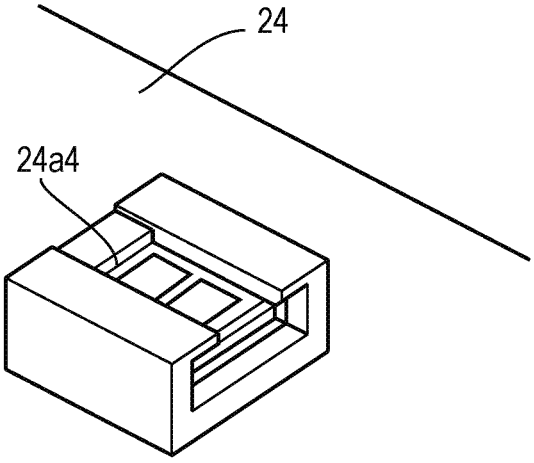
FIG. 11 is a perspective view illustrating a state where the memory is attached to the memory support portion illustrated in FIG. 10A.

FIG. 10B is a sectional view taken along a line R-R illustrated in FIG. 4, the memory 200 is supported by a memory sealing material grounding face 24*a*5 of the memory support portion 24*a*, and a convex portion 24*al* of the memory support portion 24*a* prevents the memory 200 from being detached in the arrow Z direction. Further, displacement in the arrow Y direction of the memory 200 is restricted by the inner face 24*a*3 of the memory support portion 24*a*. The inner face 24*a*3 serves as a portion for restricting displacement in the Y direction. The memory sealing material grounding face 24*a*5 serves as a portion for restricting displacement in the Z direction (downward direction), and the convex portion 24*a*1 serves as a portion for restricting displacement in the Z direction (upward direction).

Figure 16:
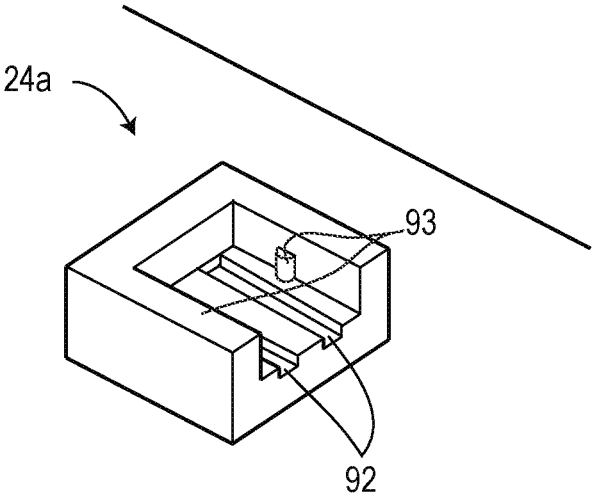
FIG. 16 is a perspective view of the memory support portion provided with a press-fit portion.
Figure 17:
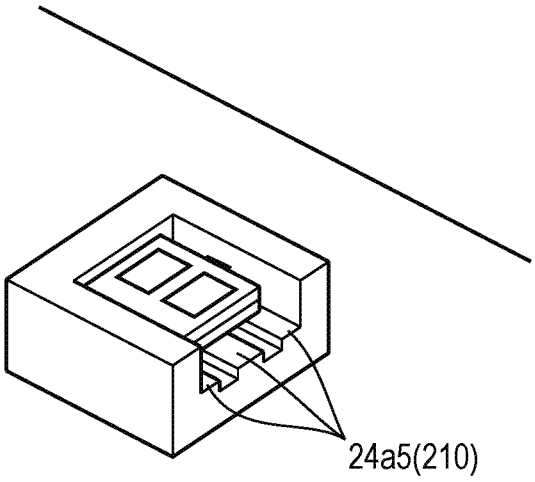
FIG. 17 is a perspective view illustrating a state where the memory is attached to the memory support portion illustrated in FIG. 16.
Figure 18:
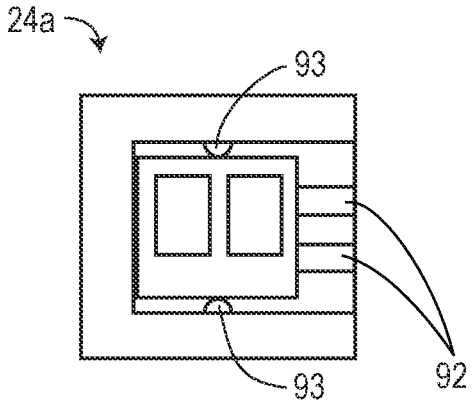
FIG. 18 is a plan view illustrating a state where the memory is attached to the memory support portion illustrated in FIG. 16.

Further, the leading side in the insertion direction of the memory 200 is restricted by an end face 24*a*4 that is opposite to the opening 24*b* in the memory support portion 24*a*. The rear side in the insertion direction of the memory 200 may not particularly be restricted or may be restricted by a scheme such as a snap-fit (not illustrated). A press-fit portion 93 (see FIG. 16 to FIG. 18) that holds the memory 200 may be provided in a part of the Y direction or Z direction restriction portion for the restriction of displacement. This press-fit portion 93 may be used for the purpose of preventing the memory 200 from dropping out from the memory support portion 24*a* before completion of welding and fixing described later.

Next, a method of fixing the memory 200 to the driving side cover member 24 that is a memory support member will be described with reference to FIG. 9A, FIG. 9B, FIG. 9C, and FIG. 10B. When the memory support portion 24*a* is formed of a styrene-based resin, a styrene-based resin is contained in the sealing material of the memory 200. In such a case, for the solvent used for the purpose of adhesion (welding), a terpene-based solvent is preferable, and d-limonene is preferable among others. The reason why it is preferable to use a terpene-based solvent (for example, d-limonene) when the memory support portion 24*a* is formed of a styrene-based resin is in a mechanism that the terpene-based solvent dissolves the styrene-based resin (Japanese Patent Application Laid-Open No. 2005-31652). When a terpene-based solvent is used when each component to be bonded contains a styrene-based resin, only the surface layer of the component is dissolved by the terpene-based solvent, and the dissolved portions are closely fit and integrated. The terpene-based solvent is then evaporated and scattered, and thereby eliminated from the memory sealing material grounding face 24*a*5 of the memory support portion 24*a* and an opposite face 200*d*1, which faces the memory sealing material grounding face 24*a*5, of the memory 200. As a result, the opposite face 200*d*1, which faces the memory sealing material grounding face 24*a*5, of the sealing material 200*d* and the memory sealing material grounding face 24*a*5 of the memory support portion 24*a* are fixed to each other.

The terpene-based solvent used for fixing (welding) may be as follows, for example: d-limonene, l-limonene, dl-limonene, d-α-pinene, d-β-pinene, α-terpinene, β-terpinene, γ-terpinene, terpinolene, 2-carene, d-3-carene, l-3-carene, or phellandrene. Among others, it is preferable to use d-limonene, l-limonene, or dl-limonene, and it is particularly preferable to use d-limonene. Since the viscosity of d-limonene is 0.98 cP at 25 degrees Celsius, which is substantially the same as water, the d-limonene can be supplied by a capillary phenomenon of permeation into a fine space as described previously.

Figure 9A:
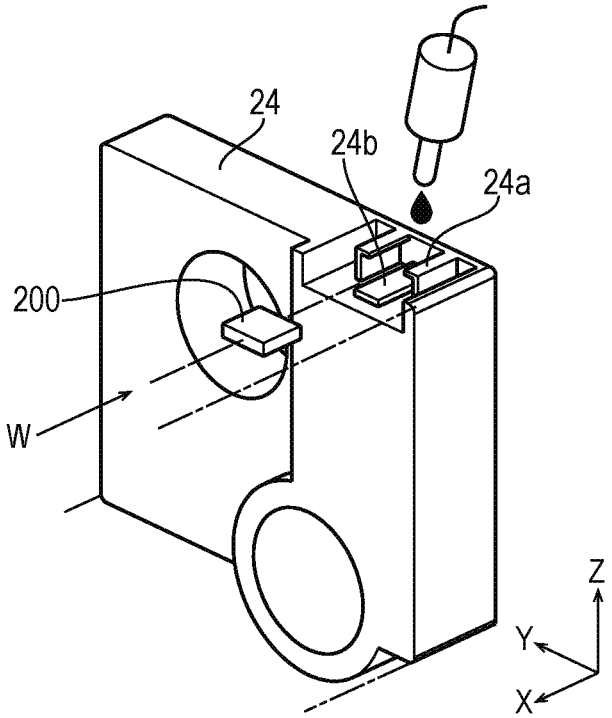
FIG. 9A is an exploded perspective view of a main portion of a cartridge of an implementation.
Figure 9B:
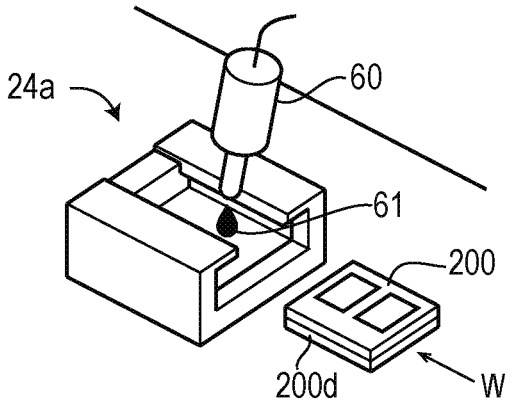
FIG. 9B is a perspective view illustrating an implementation to attach a memory after application of a solvent.
Figure 9C:
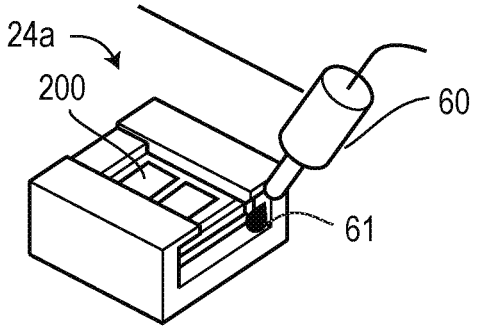
FIG. 9C is a perspective view illustrating an implementation to attach a memory before application of a solvent.
Figure 13:
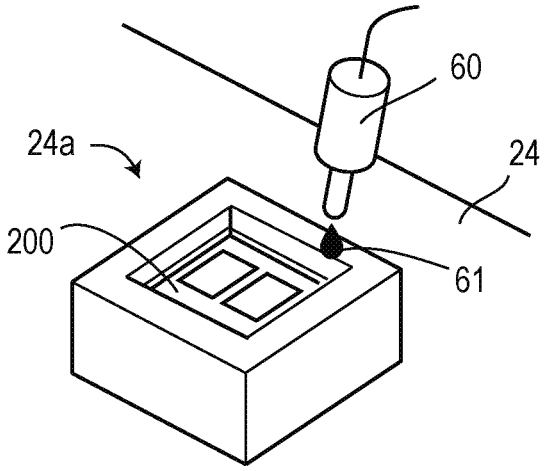
FIG. 13 is a perspective view illustrating another implementation to attach a memory before application of a solvent.

Thus, as illustrated in FIG. 9C and FIG. 13, d-limonene 61 is applied by a solvent application device 60 with the memory 200 being attached to the memory support portion 24*a*, and thereby the limonene is supplied to the interface between the memory sealing material grounding face 24*a*5 and the opposite face 200*d*1. As a result, the styrene-based resin present at the interface between both members is melted, closely fit, and integrated, and thereby fixed as described previously. The solvent application device 60 that applies the limonene 61 is a very inexpensive device.

Figure 12:
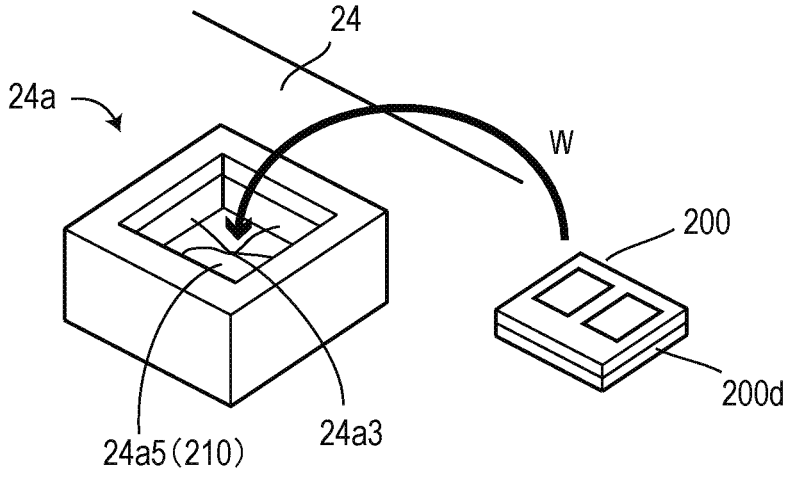
FIG. 12 is a perspective view illustrating another implementation to attach a memory after application of a solvent.

With respect to the timing of application of d-limonene, as illustrated in FIG. 9B and FIG. 12, the d-limonene may be applied before the memory 200 is attached to the memory support portion 24*a*, and the memory 200 may be attached after the application. In such a case, to use the capillary phenomenon described above, the welding between components by the d-limonene requires that the interfaces of the components to be welded be in contact with or close to each other. The expression of being close to each other means a state where one component is within 0.15 mm of the other component. This is a rough estimate of the gap between components that can be welded and fixed in accordance with a mechanism that respective components containing a styrene resin melted by the limonene are melted, the components come into contact with each other at the interfaces thereof, and the contacted interfaces are welded. Thus, a portion in contact with the portion that forms the memory support portion 24*a* provided to restrict displacement of the memory 200 described above and has a gap of about 0.15 mm or less to the sealing material 200*d* is welded (fixed). Thus, when the gap between a sealing material side face 200*d*3 and the inner face 24*a*3 of the memory support portion 24*a* also is 0.15 mm or less, these faces are welded and fixed to each other in the same manner.

Figure 14:
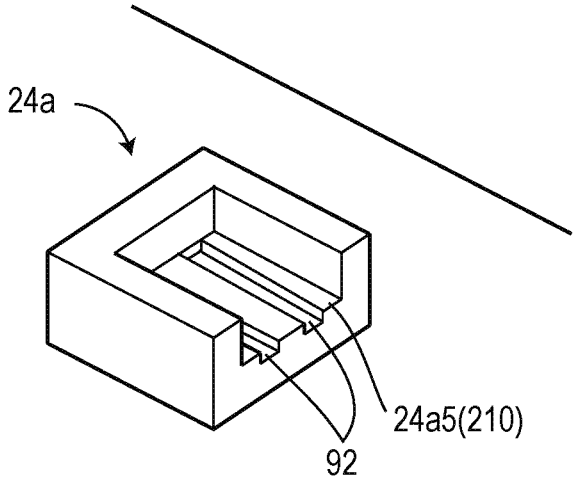
FIG. 14 is a perspective view of a memory support portion provided with an undercut for a solvent.
Figure 15:
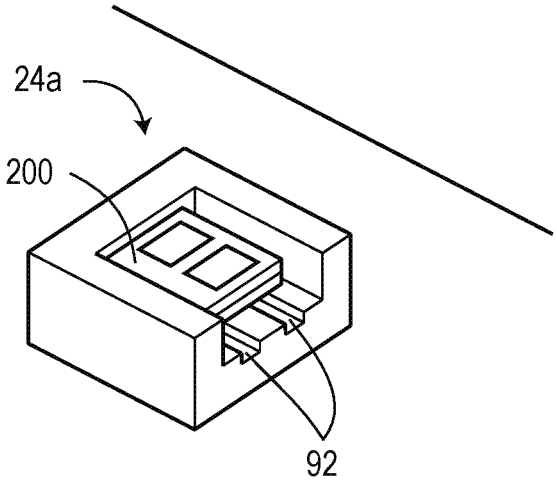
FIG. 15 is a perspective view illustrating a state where the memory is attached to the memory support portion illustrated in FIG. 14.
Figure 19:
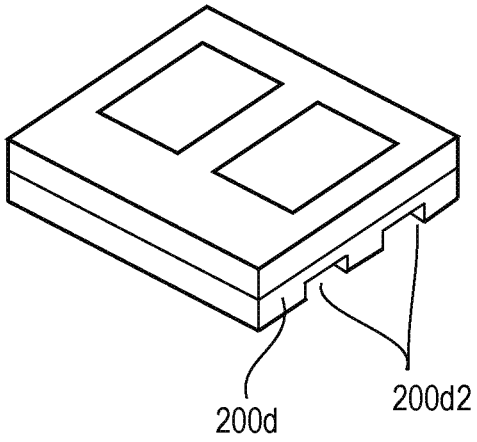
FIG. 19 is a perspective view of a memory in which a groove is provided in a sealing material.
Figure 20:
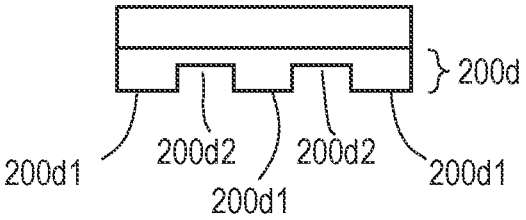
FIG. 20 is a side view of the memory illustrated in FIG. 19.
Figure 21:
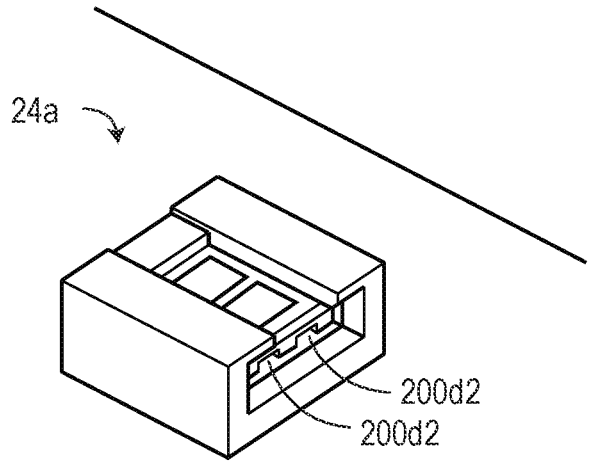
FIG. 21 is a perspective view illustrating a state where the memory illustrated in FIG. 19 is attached to the memory support portion.

Another implementation will be described with reference to FIG. 14, FIG. 15, FIG. 19, FIG. 20, and FIG. 21. As described previously, the welding between components by the d-limonene requires that the interfaces of components to be welded be in contact with or close to each other (within about 0.15 mm or less). In other words, components can only be welded in such a state. By using such a property (mechanism), it is possible to specify (limit) a position to be welded and fixed. It is also possible to reduce the welding strength by providing an undercut 92 in the memory sealing material grounding face 24*a*5 of the memory support portion 24*a* so that the memory sealing material grounding face 24*a*5 does not come into contact with or come close to the sealing material 200*d* of the memory 200 to avoid welding by the limonene and reduce the welding area (FIG. 14, FIG. 15). The welding strength can be increased by increasing the welding area. That is, the welding strength can be controlled by increasing or decreasing the welding area. As illustrated in FIG. 19 and FIG. 20, the welding area may be reduced by providing a groove 200*d*2 in the opposite face 200*d*1, which faces the memory support portion 24*a*, of the sealing material 200*d*.

As the terpene-based solvent, a solvent in which polystyrene is dissolved in advance in the terpene-based solvent may be used. In a case of a solvent in which about 10% or so by mass of polystyrene is dissolved, substantially the same effect as the case of the terpene-based solvent used alone is obtained for the bonding (welding) strength. However, when a large amount of polystyrene is dissolved, the viscosity of the solvent rises, and the capillary phenomenon tends to be less likely to occur. When the capillary phenomenon is less likely to occur, the memory 200 can be assembled after the terpene-based solvent is applied to the memory sealing material grounding face 24*a*5 of the memory support portion 24*a* (see FIG. 9B and FIG. 12).

Further, by using a mixture solution with another material, for example, a mixture solution of isopropyl alcohol (IPA) and d-limonene, it is possible to shorten the time required before two components are sufficiently coupled. In the present implementation, the driving side cover member 24 is used as a memory support component (memory support member), and the memory 200 is attached to the memory support portion 24*a* provided to the cover member 24. However, the memory support component may be provided to the cleaning unit 8 or the developing device 9 instead of the driving side cover member 24.

The present disclosure relates to a cartridge provided in a detachably attachable manner to an apparatus body of an image forming apparatus that forms an image on a recording medium and is not limited to the electro-photographic technology and the cartridge related thereto described as the above implementations. The image forming apparatus means a unit that forms an image on a recording medium. Specifically, the image forming apparatus is an apparatus that forms an image on a recording medium by using an electro-photographic image forming system, for example. An example of the electro-photographic image forming apparatus may include, for example, an electro-photographic copying machine, electro-photographic printer (for example, a laser printer, an LED printer, or the like), a facsimile machine, a word processor, and a multifunction peripheral thereof (multifunction printer or the like). Further, an example of the image forming apparatus may include an ink-jet printer using ink supplied from an ink cartridge. Furthermore, an example of the image forming apparatus may include a typewriter, a dot-impact printer, or a thermal transfer printer using an ink ribbon. Further, a cartridge is a unit product that forms an image on a recording medium and has a toner in a case of the electro-photographic system, ink in a case of an ink-jet system, or ink in a case of a system using an ink ribbon.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-100670, filed Jun. 10, 2020, which is hereby incorporated by reference herein in its entirety.

What is claimed is:

1. A cartridge provided in a detachably attachable manner to an apparatus body of an image forming apparatus that forms an image on a recording medium, the cartridge comprising:

a memory; and a memory support member that supports the memory, wherein the memory has:

a semiconductor device that stores information related to a cartridge, a sealing material that protects the semiconductor device, the sealing material containing an inorganic filler and an epoxy resin, and a cartridge electrical contact configured to be electrically connectable to a body electrical contact of the apparatus body in order to transfer information on the semiconductor device to the image forming apparatus body, the sealing material and the memory support member contain the same type of a thermoplastic resin, the sealing material and the memory support member have bonding faces, and at least parts of the bonding faces are welded and fixed by a solvent.

2. The cartridge according to claim 1, wherein the thermoplastic resin is a styrene-based resin.

3. The cartridge according to claim 2, wherein the styrene-based resin is polystyrene.

4. The cartridge according to claim 1, wherein the solvent is a terpene-based solvent.

5. The cartridge according to claim 4, wherein the terpene-based solvent is d-limonene.

6. The cartridge according to claim 1, wherein a content of the thermoplastic resin contained in the sealing material is 2 to 40% by mass with respect to the mass of the sealing material.

7. The cartridge according to claim 6, wherein a content of the inorganic filler is 40 to 95% by mass with respect to the mass of the sealing material, and wherein a content of the epoxy resin is 3 to 30% by mass with respect to the mass of the sealing material.

8. The cartridge according to claim 1, wherein the memory support member has a groove in a grounding face facing the sealing material.

9. The cartridge according to claim 1, wherein the sealing material has a groove in an opposite face facing the memory support member.

10. A manufacturing method of a cartridge, wherein the cartridge is a cartridge provided in a detachably attachable manner to an apparatus body of an image forming apparatus that forms an image on a recording medium, the cartridge has a memory and a memory support member that supports the memory, the memory has a semiconductor device that stores information related to a cartridge, a sealing material that protects the semiconductor device, the sealing material containing an inorganic filler and an epoxy resin, and a cartridge electrical contact configured to be electrically connectable to a body electrical contact of the apparatus body in order to transfer information on the semiconductor device to the image forming apparatus body, the sealing material and the memory support member contain the same type of a thermoplastic resin, and the sealing material and the memory support member have bonding faces, the manufacturing method comprising:

welding and fixing the sealing material and the memory support member by using a solvent.

* * * * *